US006786820B2

(12) United States Patent
Gerrard et al.

(10) Patent No.: US 6,786,820 B2
(45) **Date of Patent: *Sep. 7, 2004**

(54) GAMING DEVICE HAVING A DESTINATION PURSUIT BONUS SCHEME WITH ADVANCE AND SETBACK CONDITIONS

(75) Inventors: Peter Gerrard, Prestwich (GB); Anthony J. Baerlocher, Reno, NV (US); Dov L. Randall, Whitefield (GB)

(73) Assignee: IGT, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/288,750

(22) Filed: Nov. 6, 2002

(65) Prior Publication Data

US 2003/0060260 A1 Mar. 27, 2003

Related U.S. Application Data

(63) Continuation of application No. 09/686,409, filed on Oct. 11, 2000, now Pat. No. 6,494,785.

(51) Int. Cl.[7] ..... A63F 9/24
(52) U.S. Cl. ..... 463/20; 463/16; 463/26
(58) Field of Search ..... 463/16–22, 25, 463/26, 27, 28; 273/143 R, 138.1, 138 A

(56) References Cited

U.S. PATENT DOCUMENTS

| | | | |
|---|---|---|---|
| 4,448,419 | A | 5/1984 | Telnaes |
| 4,582,324 | A | 4/1986 | Koza et al. |
| 4,624,459 | A | 11/1986 | Kaufman |
| 4,695,053 | A | 9/1987 | Vazquez, Jr. et al. |
| 4,991,848 | A | 2/1991 | Greenwood et al. |
| 5,178,390 | A | 1/1993 | Okada |
| 5,205,555 | A | 4/1993 | Hamano |

(List continued on next page.)

FOREIGN PATENT DOCUMENTS

| | | | |
|---|---|---|---|
| EP | 08774337 | A1 | 10/1998 |
| EP | 0926645 | A1 | 6/1999 |
| EP | 0944030 | A2 | 9/1999 |
| EP | 0945837 | A1 | 9/1999 |
| EP | 0981119 | A2 | 2/2000 |
| EP | 0984408 | A2 | 3/2000 |
| EP | WO 00/12186 | | 3/2002 |
| EP | 0984409 | A2 | 3/2002 |
| GB | 2 106 293 | A | 4/1983 |
| GB | 2 191 030 | A | 12/1987 |
| GB | 2 225 889 | A | 6/1990 |
| GB | 2 226 436 | A | 6/1990 |
| GB | 2 242 300 | A | 9/1991 |
| WO | WO 9732285 | | 9/1997 |

OTHER PUBLICATIONS

Chutes & Ladders Game Instructions written by Hasbro–Milton Bradley, published in 1999.

(List continued on next page.)

*Primary Examiner*—Michael O'Neill
(74) *Attorney, Agent, or Firm*—Bell, Boyd & Lloyd, LLC

(57) ABSTRACT

A gaming device having a plurality of locations, at least one destination location, a player symbol, an award associated with the destination location which is provided to the player if the player symbol reaches the destination location, a setback condition associated with one of the locations, wherein when the player symbol moves to the location having the associated setback condition, the player symbol is relocated to one of the locations further from the destination location based on the setback condition, an advance condition associated with one of the locations, wherein when the player symbol moves to the location having the advance condition, the player symbol is relocated to one of the locations closer to the destination location based on the advance condition, and a plurality of awards associated with the locations, wherein the award associated with one of the locations is provided to the player if the player does not reach the destination location.

46 Claims, 8 Drawing Sheets

U.S. PATENT DOCUMENTS

| | | | |
|---|---|---|---|
| 5,342,047 | A | 8/1994 | Heidel et al. |
| 5,456,465 | A | 10/1995 | Durham |
| 5,524,888 | A | 6/1996 | Heidel |
| 5,536,016 | A | 7/1996 | Thompson |
| 5,542,669 | A | 8/1996 | Charron et al. |
| 5,560,603 | A | 10/1996 | Seelig et al. |
| 5,611,535 | A | 3/1997 | Tiberio |
| 5,695,402 | A | 12/1997 | Stupak |
| 5,711,525 | A | 1/1998 | Breeding |
| 5,769,716 | A | 6/1998 | Saffari et al. |
| 5,772,509 | A | 6/1998 | Weiss |
| 5,775,692 | A | 7/1998 | Watts et al. |
| 5,788,573 | A | 8/1998 | Baerlocher et al. |
| 5,823,874 | A | 10/1998 | Adams |
| 5,833,538 | A | 11/1998 | Weiss |
| 5,848,932 | A | 12/1998 | Adams |
| 5,851,148 | A | 12/1998 | Brune et al. |
| 5,873,781 | A | 2/1999 | Keane |
| 5,882,261 | A | 3/1999 | Adams |
| 5,902,184 | A | 5/1999 | Bennett |
| 5,911,418 | A | 6/1999 | Adams |
| 5,947,820 | A | 9/1999 | Morro et al. |
| 5,951,397 | A | 9/1999 | Dickinson |
| 5,964,463 | A | 10/1999 | Moore, Jr. |
| 5,967,894 | A | 10/1999 | Kinoshita et al. |
| 5,980,384 | A | 11/1999 | Barrie |
| 5,984,781 | A | 11/1999 | Sunaga |
| 5,997,400 | A | 12/1999 | Seelig et al. |
| 5,997,401 | A | 12/1999 | Crawford |
| 6,004,207 | A | 12/1999 | Wilson, Jr. et al. |
| 6,015,346 | A | 1/2000 | Bennett |
| 6,017,033 | A | 1/2000 | Keller |
| 6,019,369 | A | 2/2000 | Nakagawa et al. |
| 6,033,307 | A | 3/2000 | Vancura |
| 6,056,642 | A | 5/2000 | Bennett |
| 6,059,289 | A | 5/2000 | Vancura |
| 6,059,658 | A | 5/2000 | Mangano et al. |
| 6,062,980 | A | 5/2000 | Luciano |
| 6,089,976 | A | 7/2000 | Schneider et al. |
| 6,089,977 | A | 7/2000 | Bennett |
| 6,089,978 | A | 7/2000 | Adams |
| 6,093,102 | A | 7/2000 | Bennett |
| 6,102,798 | A | 8/2000 | Bennett |
| 6,120,031 | A | 9/2000 | Adams |
| 6,126,541 | A | 10/2000 | Fuchs |
| 6,126,542 | A | 10/2000 | Fier |
| 6,142,873 | A | 11/2000 | Weiss et al. |
| 6,142,874 | A | 11/2000 | Kodachi et al. |
| 6,142,875 | A | 11/2000 | Kodachi et al. |
| 6,146,273 | A | 11/2000 | Olsen |
| 6,159,095 | A | 12/2000 | Frohm et al. |
| 6,159,096 | A | 12/2000 | Yoseloff |
| 6,159,097 | A | 12/2000 | Gura |
| 6,159,098 | A | 12/2000 | Slomiany et al. |
| 6,162,121 | A | 12/2000 | Morro et al. |
| 6,168,520 | B1 | 1/2001 | Baerlocher et al. |
| 6,168,523 | B1 | 1/2001 | Piechowiak et al. |
| 6,173,955 | B1 | 1/2001 | Perrie et al. |
| 6,174,233 | B1 | 1/2001 | Sunaga et al. |
| 6,174,235 | B1 | 1/2001 | Walker et al. |
| 6,190,254 | B1 | 2/2001 | Bennett |
| 6,190,255 | B1 | 2/2001 | Thomas et al. |
| 6,203,429 | B1 | 3/2001 | Demar et al. |
| 6,210,279 | B1 | 4/2001 | Dickinson |
| 6,213,876 | B1 | 4/2001 | Moore, Jr. |
| 6,224,483 | B1 | 5/2001 | Mayeroff |
| 6,231,442 | B1 | 5/2001 | Mayeroff |
| 6,231,445 | B1 | 5/2001 | Acres |
| 6,261,177 | B1 | 7/2001 | Bennett |
| 6,302,790 | B1 | 10/2001 | Brossard |
| 6,305,686 | B1 | 10/2001 | Perrie et al. |
| 6,309,300 | B1 | 10/2001 | Glavich |
| 6,328,649 | B1 | 12/2001 | Randall et al. |
| 6,375,187 | B1 | 4/2002 | Baerlocher |

OTHER PUBLICATIONS

Adders and Ladders Brochure written by Barcrest Ltd., published.

Top Dollar Game Brochures written by IGT, published in 1998.

East Street Brochures and Articles written by Casino Data System, published in 2000.

Monopoly Brochures and Articles written by WMS Gaming, Inc, published in 1998, 1999 and 2000.

Fox "N" Hound Brochure written by IGT, published in 2000.

Elvis Brochure and Article written by IGT, published in 1999.

Adams Family Advertisement and Article written by IGT, Strictly Slots, published in 2000.

American Thunder Screen Shots written by IGT, published in 1998.

Big Bang Piggy Bankin Advertisement written by WMS Gaming, Inc., published prior to 2000.

Blackjack/Twenty–One Description written by Hoyle's Rules of Games, published in 1993.

Bonus Spin Red, White & Blue Advertisement written by IGT, published in 2000.

Bonus Times Article written by Strictly Slots, published in 2000.

By George written by IGT, published in 2002.

Caribbean Gold II Advertisement written by Aristocrat Incorporated, published in 1998.

Cash Box Advertisement & Article written by Anchor Games, Strictly Slots, published in 2000.

Description of Let's Make a Deal Television Show written by letsmakeadeal.com (2 pages), printed on Mar. 16, 2001.

Double Diamond Game Descriptions written by IGT, printed on Mar. 21, 2001.

Double Up Poker Game Description written by IGT, Undated.

Empire Game Advertisement written by AC Coin, published in 1996.

In Between Game Description written by IGT, available prior to 2000.

Jackpot Party Advertisements and Articles written by WMS Gaming, Inc., published in 1998.

Keep Your Hat On Advertisement written by Aristocrat, published in 2001.

Let's Make a Deal written by geocities.com (10 pages), printed on Mar. 21, 2001.

Let's Make a Deal written by fortunecity.com (4 pages), printed on Mar. 21, 2001.

Let's Make a Deal written by Illinoislottery.com (1 page), printed on Mar. 21, 2001.

Let's Make a Deal geocities.com (2 pages), printed on Mar. 16, 2001.

Let's Make A Deal Advertisement written by Shufle Master and IGT, published in 2001.

Let's Make a Deal Game Advertisement written by Bally Gaming Systems, published in 1999.

Little Green Men Advertisement and Article written by IGT, Strictly Slots, published in 2000.

MegaJackpots Advertisement written by IGT, published in 1998.

Money Grab Article written by Strictly Slots, published in Apr. 2001.
Money in the Bank Advertisement written by Strictly Slots Konami, published in 2001.
Monopoly Party Train Article written by Strictly Slots, published in 2002.
Neon Nights written by IGT, published in 2000.
On the Money Article written by Strictly Slots, Casino Data Systems, published in Dec. 2000.
Polly & Roger Advertisement written by VLC, Inc., published in 2000.
Price is Right "Cliff Hangers" Description written by www-.geocities.com; members.aol.com (web site), printed Mar. 21, 2001.
Price is Right "Showcases" Description written by schuminweb.com (web site), printed Mar. 16, 2001.
Psycho Cash Beast Club (including knockouts) written by Barcrest, published prior to 1998.
Richard Petty Advertisement written by IGT, published in 2000.
South Park—Dodgeball Advertisement written by IGT, published in 2000.
Spell Binder Advertisement written by IGT, published in 2000.
Sphinx Advertisement written by Atronic Casino Technology, Ltd., published in 1997.
Take Your Pick Article written by Strictly Slots, published in Mar. 2001.
Take Your Pick Advertisement written by IGT/Anchor Gaming, published in 1999.
Texas Tea Advertisement written by IGT, published in 2000.
The Deals of Let's Make a Deal written by fortunecity.com (2 pages), printed on Mar. 16, 2001.
The Official Let's Make a Deal Website written by Bally Gaming System Website, printed on Mar. 16, 2001.
Top Cat Advertisement written by WMS Gaming, Inc., published prior to 2000.
Totem Pole Advertisement written by IGT, published in 1997.
Treasure Wheel/Treasure Tunnel Advertisement written by Sigma Game, Inc., published prior to 2000.
Wheel of Fortune Advertisement written by IGT, published in 1998.
Wheel of Fortune Advertisement written by IGT, published in 1999.
Wheel Poker Article written by Strictly Slots (Anchor Games), published in Nov. 2000.
Winning Streak Web Site Description written by WMS Gaming Inc. (web site), printed on Mar. 21, 2001.
X Factor Advertisement and Website Page written by WMS Gaming Inc., published in 1998.
Hyper Viper Advertisement written by Barcrest, published in Apr. 1983.

104
102
START
100
106
DESTINATION 104
100
102
START
56
106
DESTINATION 104
100
102
START
106
56
DESTINATION 104
100
102
START
56
106
DESTINATION 104
100
START
106
102
DESTINATION

GAMING DEVICE HAVING A DESTINATION PURSUIT BONUS SCHEME WITH ADVANCE AND SETBACK CONDITIONS

PRIORITY CLAIM

This application is a continuation of U.S. patent application Ser. No. 09/686,409, filed Oct. 11, 2000, now issued as U.S. Pat. No. 6,494,785.

CROSS REFERENCES TO RELATED APPLICATION

This application is related to the following commonly-owned co-pending patent applications: GAMING DEVICE WITH BONUS SCHEME PROVIDING AWARDS ASSOCIATED WITH MOVEMENTS ALONG A PATH," Ser. No. 09/583,429, and "GAMING DEVICE WITH A BONUS SCHEME INVOLVING MOVEMENT ALONG PATHS WITH PATH CHANGE CONDITIONS," Ser. No. 09/686,538.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device which has a bonus scheme which involves moving a symbol toward a destination with the possibility of advance and setback conditions occurring.

BACKGROUND OF THE INVENTION

Many existing gaming machines, such as traditional slot machines, include bonus rounds. Typically, a bonus round begins when the player reaches a bonus triggering event in the primary game of the gaming device. In slot machines with reels, the triggering event usually occurs when the player reaches a predetermined combination of symbols on the reels. Usually the bonus scheme provides the player with an opportunity to gain bonus value before the bonus round terminates.

Certain bonus schemes involve advancing a symbol from one location to another toward a destination. A player may receive bonus values when landing on various locations, and the player may also receive a relatively high bonus value when the player's symbol reaches the destination. Though these types of bonus schemes may exist, these bonus schemes do not include conditions which automatically move the symbol one or more locations backward.

To increase player enjoyment and excitement, it is desirable to provide players with new bonus schemes for gaming devices which automatically move a player's symbol backward upon the occurrence of predetermined events while the player is attempting to reach a destination.

SUMMARY OF THE INVENTION

The present invention overcomes the above shortcomings by providing a gaming device and method which has a bonus scheme which includes a plurality of locations, including at least one destination location. The gaming device also includes at least one symbol located at one of these locations. The term location, as used herein, includes any area, position or objective displayed or designated by the gaming device. A destination location is the location pursued by the player and preferably, when the player reaches the destination location, the gaming device awards the player with a relatively high bonus value or the opportunity to gain a relatively high bonus value. The term symbol, as used herein, includes any visual, or audiovisual representation or image of a person, place or thing, in motion or at rest. Preferably, the plurality of locations form a path, and the path can be shaped in any orderly or disorderly form or fashion. Furthermore, it is preferable that a bonus value is associated with each location.

In operation, the symbol begins at a predetermined location. The gaming device then moves the symbol in the direction of the destination location, preferably by enabling the player to push a play button. Depending upon the new location of the symbol, a setback condition may occur or an advance condition may occur. If a setback condition occurs, the gaming device automatically moves the symbol to a predetermined location or a predetermined number of locations away from its current location, in the opposite direction of the destination location. If an advance condition occurs, the gaming device automatically moves the symbol to a predetermined location or a predetermined number of locations from its current location in the direction of the destination location. At any time, the player can stop the bonus round and accept the bonus value associated with the present location. Alternatively, the player can move the symbol forward, preferably by pushing a play button again. With this type of bonus scheme, the gaming device preferably provides the player with a limited number of moves to reach the destination location. In pursuit of this objective, the player faces: (i) a plurality of possible setback conditions; (ii) a plurality of possible advance conditions; and (iii) the option of accepting a bonus value and ending the bonus round or continuing the bonus round and possibly receiving a lower bonus value. The setback conditions hinder the player's advancement, and the advance conditions aid the player in reaching the destination location.

Preferably, this bonus scheme also includes one or more bonus values and one or more terminating conditions associated with predetermined locations. These terminating conditions are predetermined by the gaming device and occur when one or more events occur during the bonus round. Preferably, when the symbol lands on predetermined locations, the gaming device awards the player with bonus values associated therewith. Furthermore, it is preferable that if the player reaches the destination location, the gaming device awards the player with an opportunity to gain a relatively high bonus value. In addition, it is preferable that when the symbol lands on predetermined locations, the gaming device awards the player with bonus values associated therewith and then terminates the bonus round.

In one preferred embodiment, the plurality of locations are formed in a grid-shaped path. Various bonus values are associated with each location. The symbol begins at the bottom left-hand corner of the grid and advances along the rows from the bottom row to the top row. The destination location is located in the top left-hand corner of the grid. This preferred embodiment also includes a setback condition associated with at least one location. When the player reaches such a location, a setback condition occurs and the gaming device automatically relocates the symbol accordingly. In addition, the setback condition may operate as a terminating condition, causing the gaming device to award the player with a bonus value associated with the new location and then terminate the bonus round. When the symbol lands on a predetermined symbol, an advance condition occurs and the gaming device automatically relocates the symbol accordingly. In addition, if neither a terminating condition nor advance condition occurs, the gaming device enables the player to terminate the bonus round and accept the bonus value associated with the present location, or to continue moving toward the destination location.

If the player moves the symbol to the destination location or beyond the destination location, the gaming device provides the player with an opportunity to gain a relatively high bonus value. The gaming device displays the possible bonus values which the player can gain. Preferably, the gaming device enables the player to push a play button, and the gaming device awards the player with one of these bonus values, and finally the bonus round terminates.

The present invention provides a gaming device with a bonus scheme which enables the player to move a symbol toward a destination location and provides the player with a relatively high bonus value if the player reaches the destination location. As the player pursues this destination, the player faces: (i) the decision of ending the bonus round with a particular bonus value or continuing and running the risk of receiving a lower bonus value; (ii) setback conditions which hinder the player's progress in reaching the destination location; and (iii) advance conditions which aid the player in reaching the destination location.

It is therefore an object of the present invention to provide a gaming device with a bonus scheme which includes advance and setback conditions.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
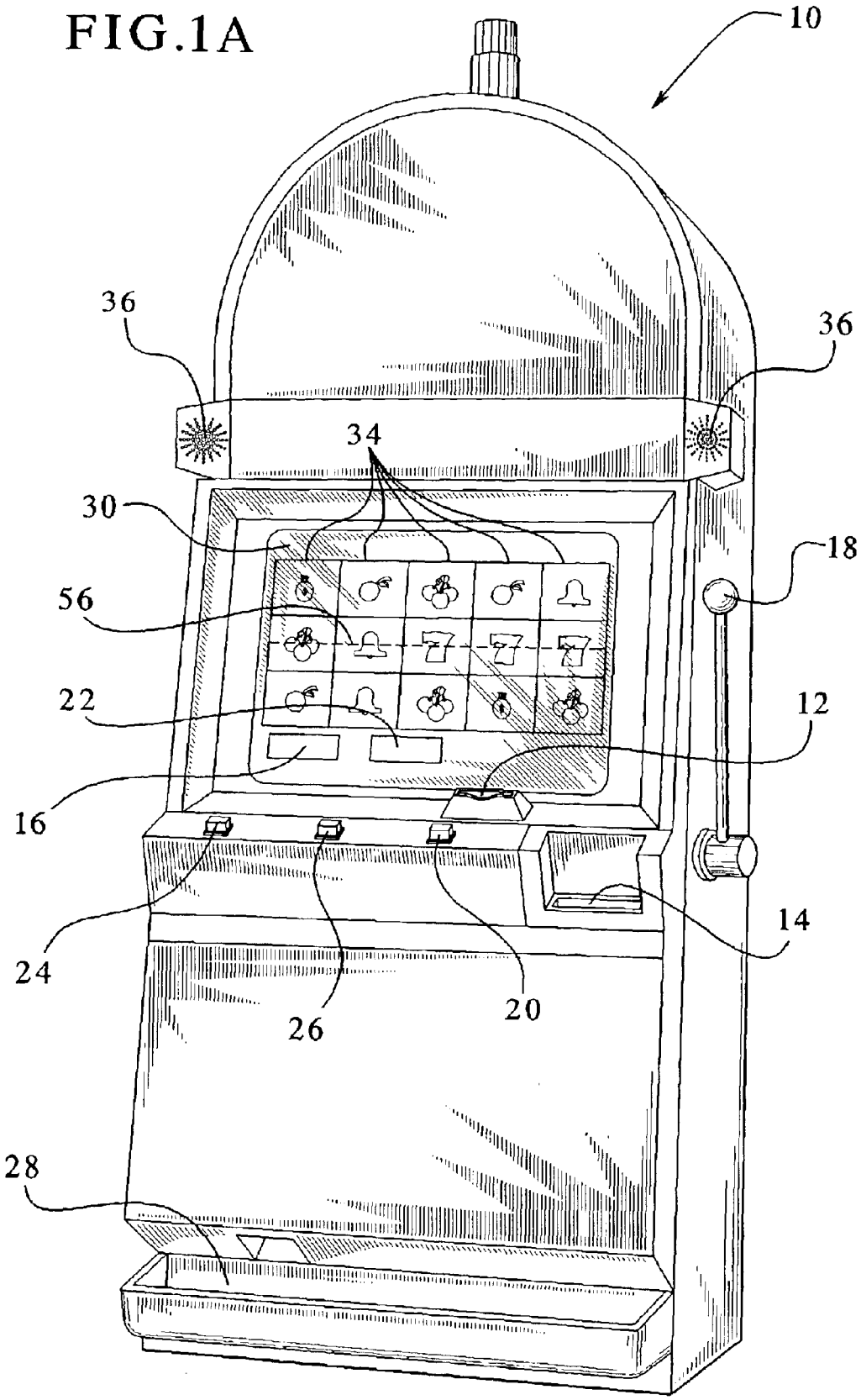
FIG. 1A is a perspective view of one embodiment of the gaming device of the present invention.
Figure 1B:
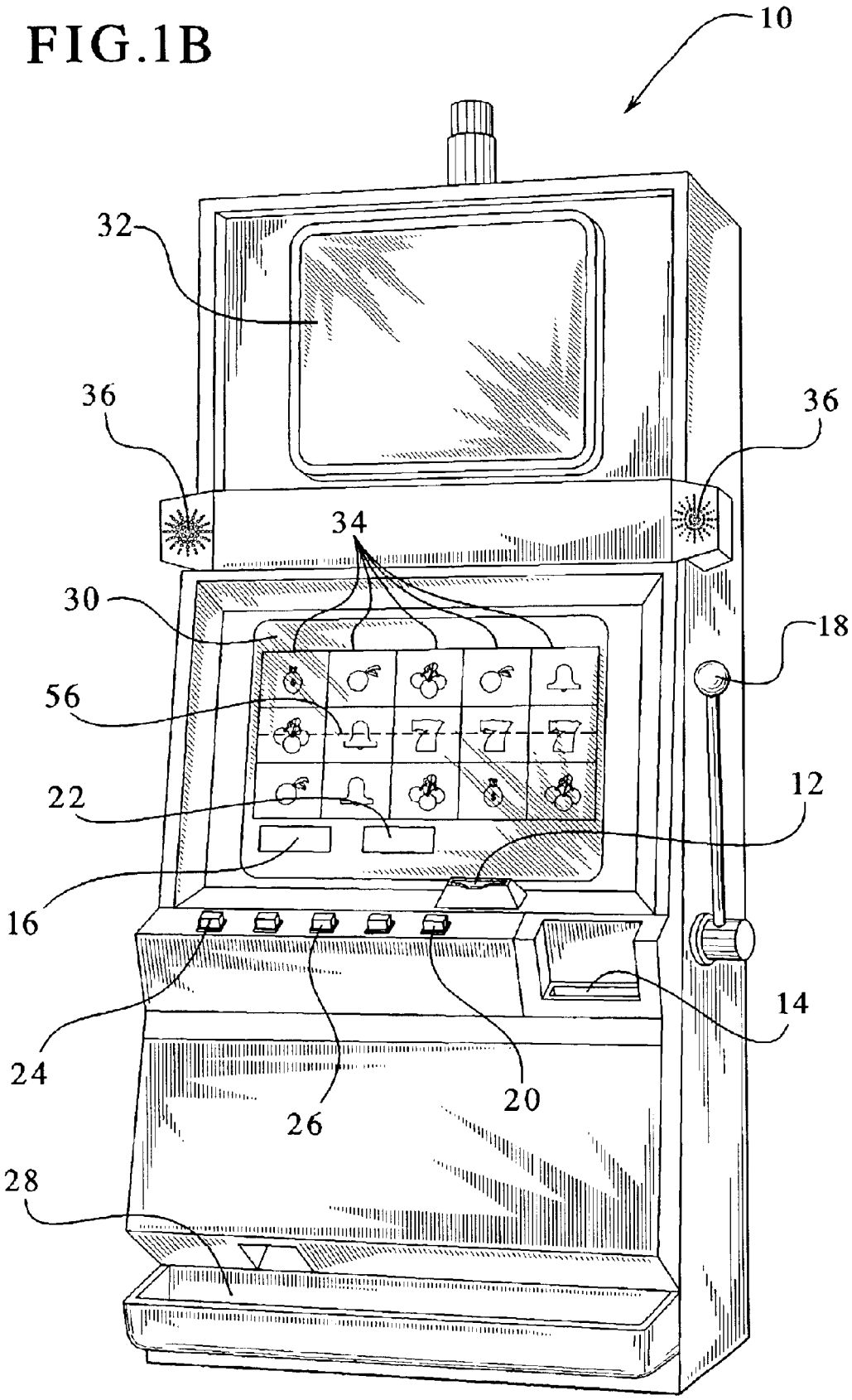
FIG. 1B is a perspective view of another embodiment of the gaming device of the present invention.

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money or ticket vouchers in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. However, it should be appreciated that the display devices can display any visual representation or exhibition, including but not limited to movement of physical objects such as mechanical reels and wheels, dynamic lighting and video images. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
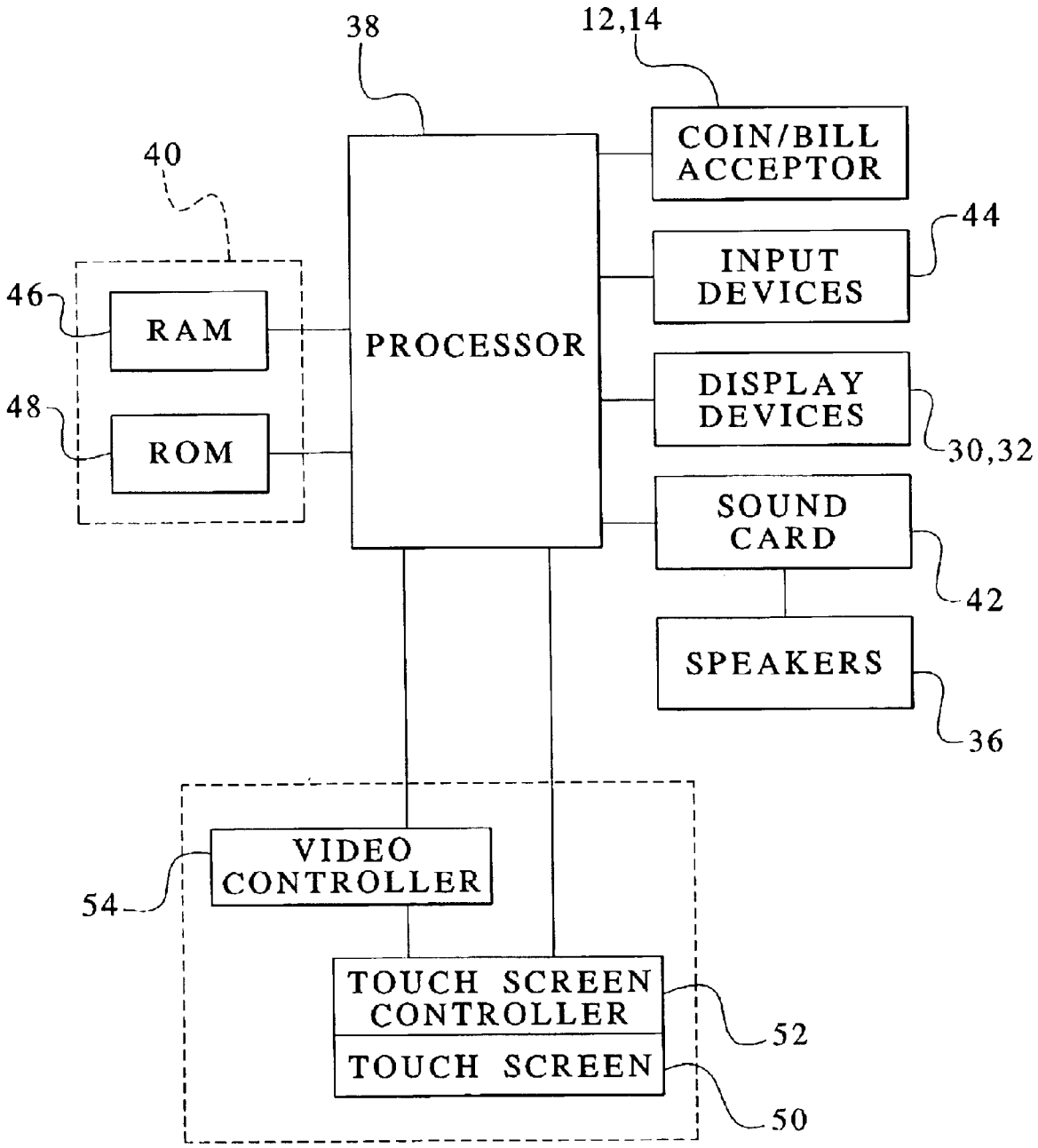
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the "computer" or "controller."

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines, such as payline 56, wherein the paylines can be horizontal, diagonal or any combination thereof.

Bonus Scheme

If a player achieves a bonus triggering or qualifying condition while playing the game, the gaming device 10 automatically initiates the bonus round of the present invention. The bonus scheme of the present invention includes a plurality of locations 100, one or more destination locations 102 and at least one symbol 104. The locations 100 can be arranged in any orderly or disorderly fashion or pattern. Preferably, locations 100 are arranged in the shape of a non-cyclical path 106.

Figure 6:
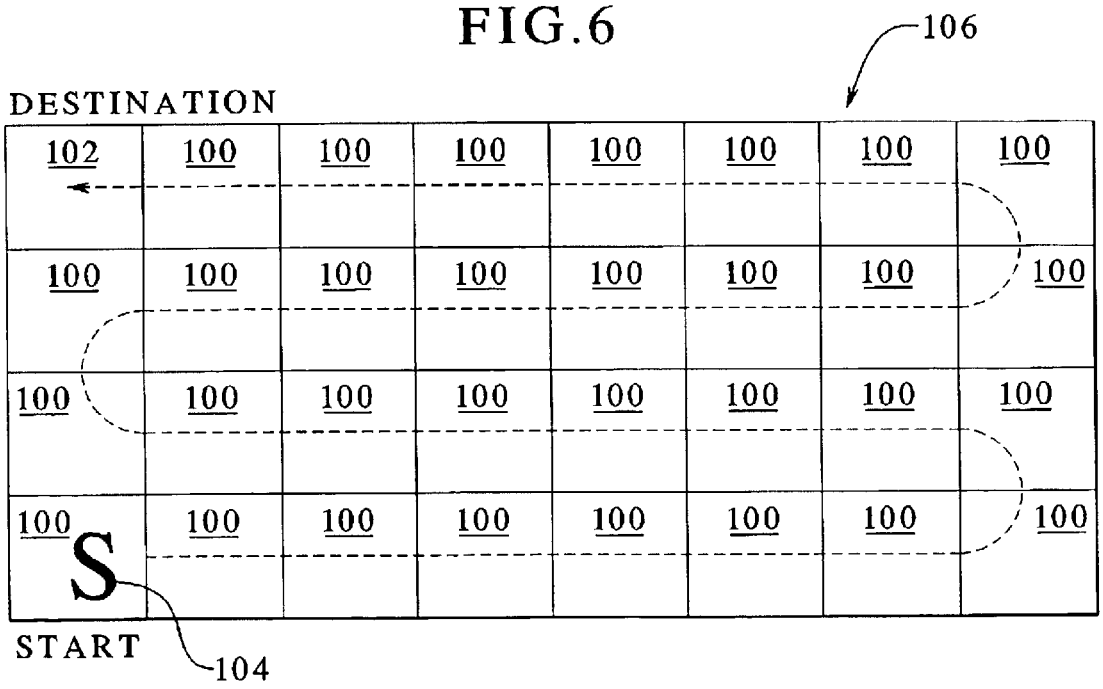
FIG. 6 is a top plan view of a grid-shaped path, including the locations and symbol in one embodiment of the present invention.

As shown in FIG. 3, a path 106 can consist of a plurality of locations 100 adjoining one another. As shown in FIG. 4, a path 106 can be in the shape of a line. Furthermore, as shown in FIG. 6, a path 106 can be in the shape of a grid, including a plurality of locations 100. It should be appreciated that the path shapes shown in FIGS. 3, 4 and 6 are merely illustrative paths 106 and that the present invention can include other types and shapes of paths 106.

Figure 4A:
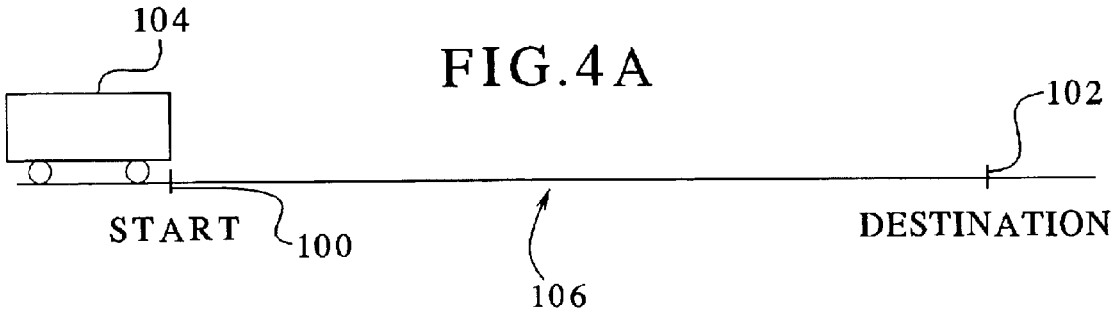
FIGS. 4A through 4E are five top plan views of a path and a symbol showing the initial position of the symbol and four moves made by the symbol in another embodiment of the present invention.
Figure 4B:
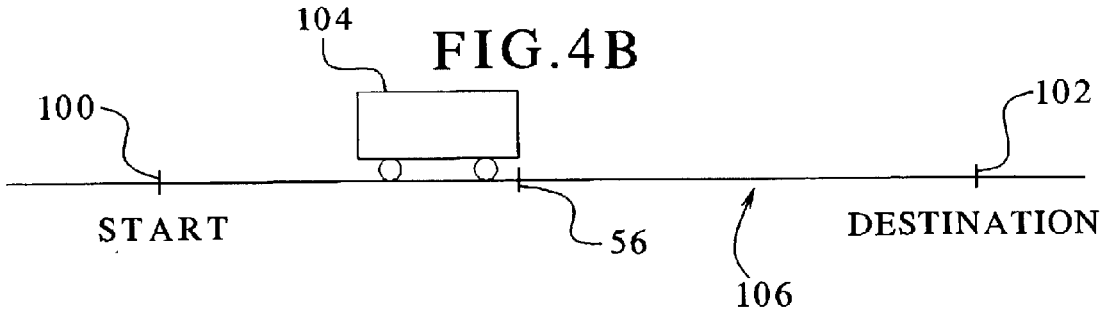
Figure 4C:
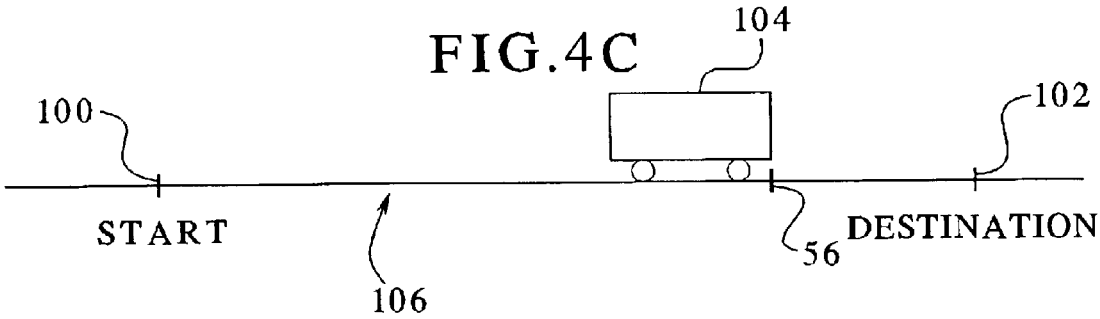
Figure 4D:
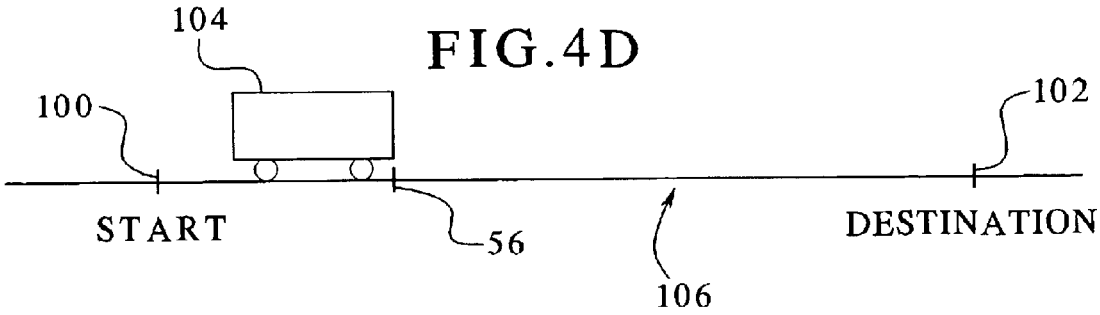
Figure 4E:
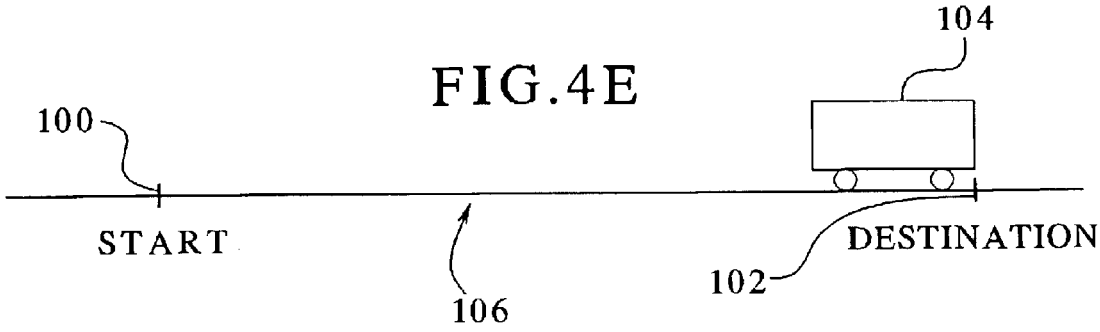
Figure 5:
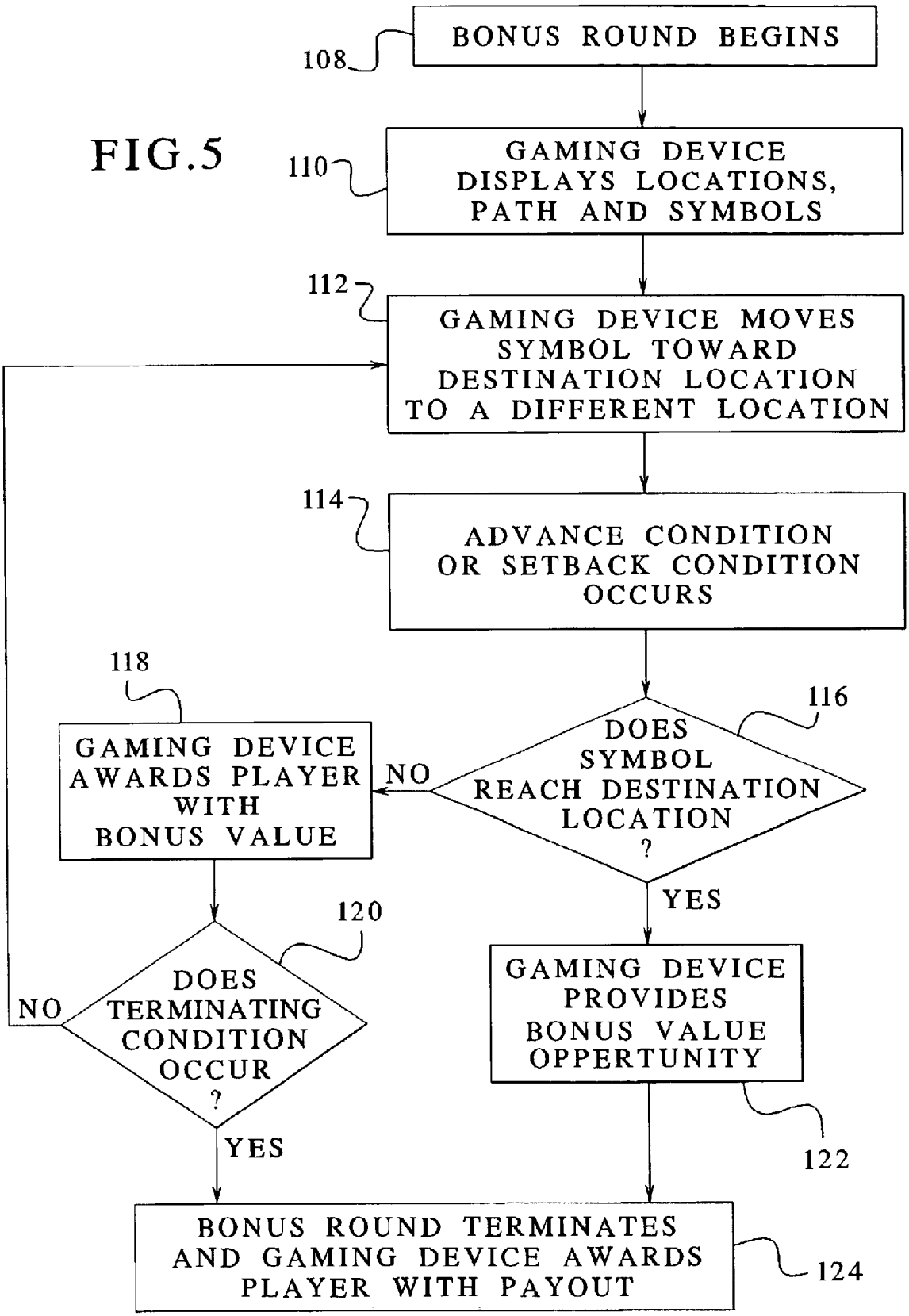
FIG. 5 is a flow diagram of one embodiment of the present invention.

With reference to FIG. 5, in operation after the bonus round begins, the gaming device displays the locations 100 (which form the path 106) and the symbol 104, as indicated by blocks 108 and 110. The starting location of symbol 104 and the destination location 102 can be located anywhere on the path 106 and are preferably predetermined by the gaming device. The examples shown in FIGS. 3, 4 and 6 indicate particular start locations 100 and destination locations 102 merely for illustrative purposes. After displaying the locations 100 and symbol 104, the gaming device then moves the symbol 104 to a different location 100 in the direction of the destination location 102, as indicated by block 110.

Figure 3A:
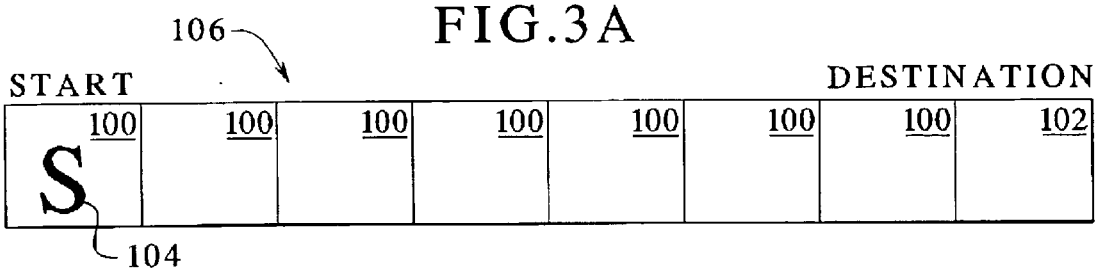
FIGS. 3A through 3E are five top plan views of a path and a symbol showing the initial position of the symbol and four moves made by the symbol in one embodiment of present invention.
Figure 3B:
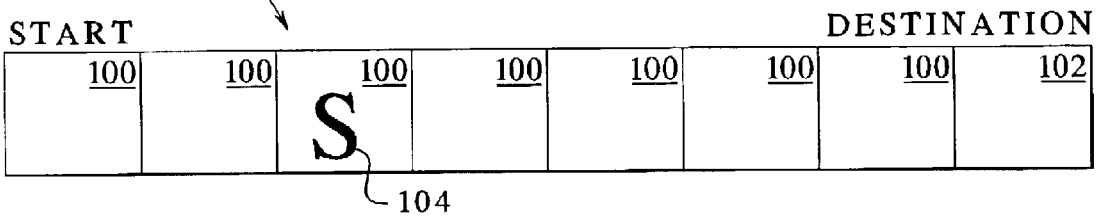

The gaming device can cause this move automatically based upon a predetermined computer program. However, it is preferable that the gaming device causes this move by enabling the player to push play button 20. After the player pushes play button 20, the gaming device preferably determines the new location 100 by random generation calculations or other calculations involving predetermined probabilities and/or outcomes. The example shown in FIG. 3 shows a path 106 at different times as the symbol 104 moves four times during a bonus round. FIG. 3A shows the starting location of symbol 104. FIG. 3B shows the initial move of symbol 104 after the player pushed play button 20 for the first time. Similarly, FIG. 4A shows the starting location of symbol 104 in a different path 106, and FIG. 4B shows the first move of this symbol 104.

Referring again to FIG. 5, after the symbol 104 is moved, either an advanced condition occurs or a setback condition occurs, as indicated by block 114. If an advance condition occurs, the gaming device will automatically move symbol 104 toward the destination location 102 to a predetermined location 100. The move caused by an advance condition is illustrated in FIGS. 3C and 4C.

If instead of reaching an advance condition, the player reaches a setback condition, the gaming device will automatically move symbol 104 away from the destination location 102. Specifically where the gaming device moves symbol 104 after an advance or setback condition occurs is preferably predetermined by the gaming device. However, the present invention can be adapted so that such a move is determined randomly after a player pushes a play button 20. As indicated by a diamond 116 and block 118 in FIG. 5, if the symbol 104 does not reach or move beyond the destination location 102 after an advance condition occurs, or if a setback condition occurs preventing the symbol 104 from reaching or moving beyond the destination location 102, the gaming device preferably enables the player to make a decision: to accept a particular bonus value associated with the present location and end the bonus round, or to continue the bonus round with the possibility of receiving a lower bonus value.

Accepting a bonus value functions as a terminating condition. It is also preferable that one or more of the setback conditions function as a terminating condition. However, any event or sequence of events can result in a terminating condition as is predetermined by the gaming device. Preferably, the gaming device provides the player with a limited number of moves or opportunities to move symbol 104 to the destination location 102. When this number is exhausted, a terminating condition occurs and the bonus round terminates. If a terminating condition occurs, the gaming device terminates the bonus round, as indicated by diamond 120 and block 124. In an alternative embodiment, a setback condition does not operate as a terminating condition and, as indicated by diamond 120 and block 112, after a setback condition occurs the gaming device will enable the player to push play button 20 again in order to move symbol 104 toward the destination location 102. This process continues until the player reaches a terminating condition or the destination location 102.

Figure 3C:
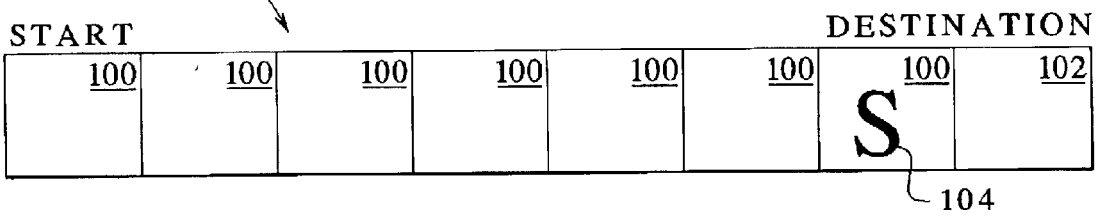
Figure 3D:
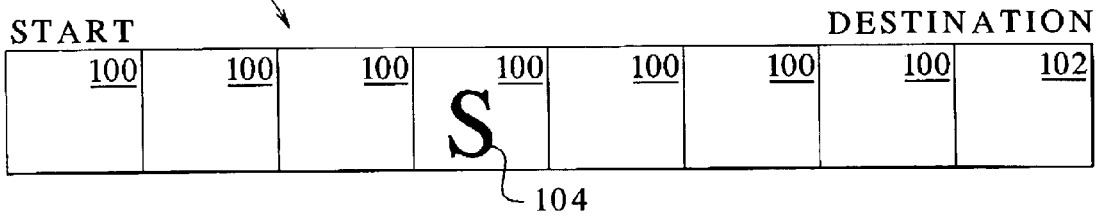
Figure 3E:
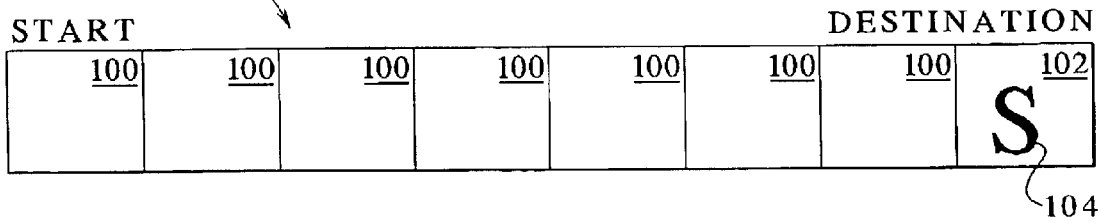

In the example shown in FIG. 3C, after pushing play button 20 for a second time, the player came within one location from reaching the destination location 102. However, this particular location 100 was associated with a setback condition which caused the symbol 104 to move backward three locations as shown in FIG. 3D. Then the player pushed play button 20 again and finally reached the destination location 102, as shown in FIG. 3E. Likewise with reference to FIG. 4, the player experienced a setback condition as shown in FIG. 4D, and then the player recovered and reached the destination location 102 as shown in FIG. 4E. Preferably a player can reach a destination location 102 by positioning symbol 104 on the destination location 102 or by receiving a move which would locate symbol 104 beyond the destination location 102. Though in these examples the player reached the destination location 102, it should be understood that this will not always be the case, and will preferably be based on the winning percentages desired by the implementation of the gaming device and on the random determination made by the gaming machines.

Referring back to FIG. 5, after the player reaches the destination location 102, the gaming device can automatically award the player with a bonus value associated with the destination location 102. However, it is preferable that the gaming device provides the player with an opportunity to gain a bonus value associated with reaching the destination location 102, as indicated by block 122. Here, the gaming device displays a set of bonus values to the player, the player pushes play button 20 and the gaming device awards the player with one of the values in that set. These bonus values are preferably relatively high in comparison to any bonus values associated with any of the locations 100. As indicated by block 124 in FIG. 5, after the player reaches a terminating condition or reaches the destination location 102, the bonus round terminates and the gaming device provides the player with any payout due to the player.

Figure 8:
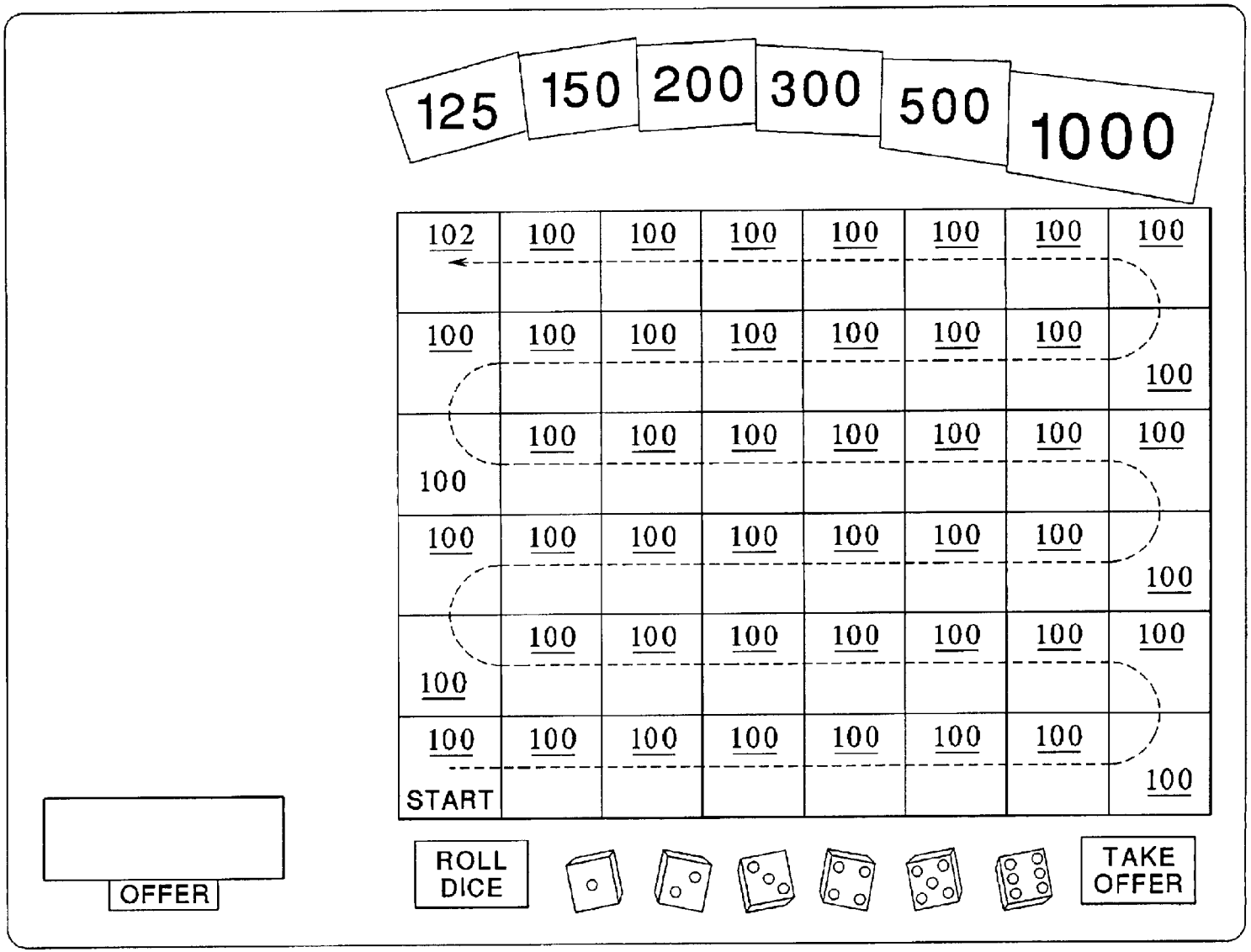
FIG. 8 is a top plan view of a grid-shaped path of one embodiment of the present invention.

In one preferred embodiment shown in FIG. 6, the player moves symbol 104 in an S-shaped pattern from the bottom of a grid toward the top of a grid. Preferably, as indicated in FIG. 6, the starting location 100 is positioned at the bottom left-hand corner of the path 106, and the destination location 102 is positioned at the top left-hand corner of the path 106. Each of the locations 100 are associated with various bonus values (not shown). As also generally illustrated in FIG. 8, when symbol 104 moves to a location 100, the gaming device enables the player to accept the associated bonus value and terminate the bonus round or to continue the bonus round. If the player continues, the player risks ending the bonus round with a bonus value lower than what the player could have received.

In addition, one or more of the locations 100 are associated with setback conditions, and one or more of these setback conditions may also operate as terminating conditions as discussed above. Furthermore, one or more of the locations 100 are associated with advance conditions which automatically move the symbol 104 toward the destination location a predetermined number of locations 100, as discussed above. If the symbol 104 reaches or would move beyond the destination location 102 the gaming device provides the player with an opportunity to gain a relatively high bonus value 126, shown in FIG. 6. Here, the gaming device displays a set of bonus values 126 and enables the player to push a play button. After pushing the play button, the gaming device provides the player with one of these bonus values 126.

Figure 7:
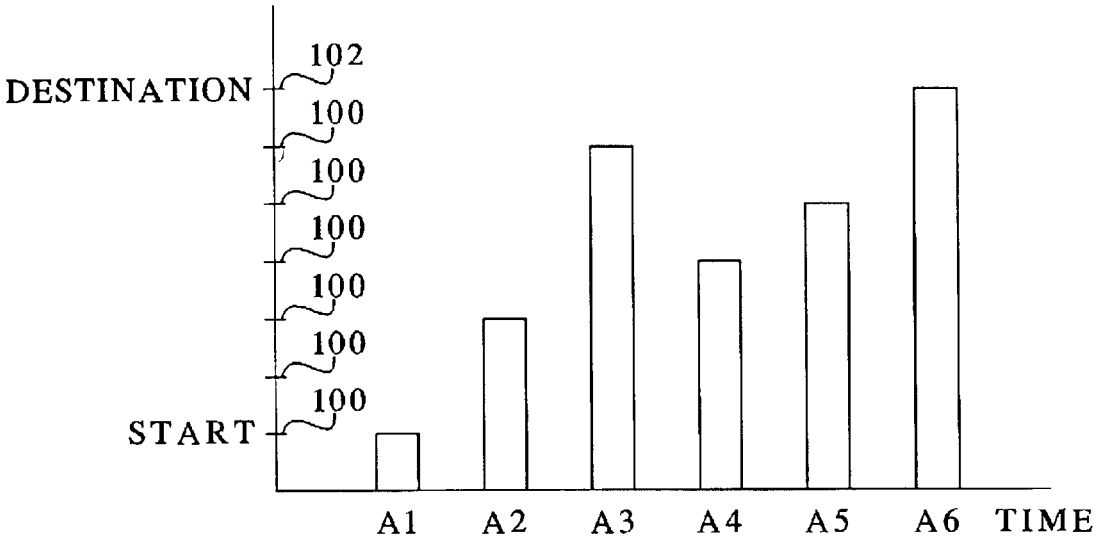
FIG. 7 is a bar graph of the locations, destination location and symbol movement in one embodiment of the present invention.

In an alternative embodiment illustrated in FIG. 7, moving to a location 100 can be the equivalent of achieving an objective, and the ultimate objective can be the destination location 102. The player begins at one of a plurality of starting locations 100, and the gaming device provides the player with a predetermined number of attempts to reach the destination location 102. In FIG. 7, the attempts are indicated by the notation A1, A2, A3, A4, A5 and A6. With attempts A1 and A2, the player moved to locations 100 associated with certain advanced conditions. The advance is indicated by elongation of the bars in FIG. 7. However, upon attempt A3, the player reached a setback condition, but thereafter, the player reached additional advance conditions. Ultimately, upon the sixth attempt, the player reached the destination location 102.

It should be appreciated that the destination location can be an objective in a point-based game. Accordingly, when the player reaches a setback condition, the gaming device can deduct points from the player, and when the player reaches advance conditions the gaming device can provide the player with points. This type of alternative embodiment is applicable to games such as boxing, golf, track and field games, and the like. It should also be appreciated that the locations can be accomplishments or goals included in games which incorporate concepts such as climbing and falling; raising and lowering; and building structures or items which deteriorate or fall apart and must be rebuilt.

The bonus scheme of the present invention involves a player who is pursuing a destination location. In pursuit of this location, the player may encounter setback conditions and advance conditions. Depending upon where the player moves a symbol, a setback condition may or may not occur. Furthermore, as the player advances from location to location, the gaming device preferably provides the player with the option of accepting a particular bonus value and ending the bonus round, or continuing the bonus round with the risk of ultimately receiving a lower bonus value. In addition, if the player reaches the destination location, the gaming device preferably awards the player with a relatively high bonus value.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is claimed as follows:

1. A gaming device operable under the control of a processor, said gaming device comprising:

a game operable upon a wager by a player;

a plurality of locations;

a destination location;

a player symbol;

at least one display device operable with the processor, wherein the display device is operable after an event associated with the game to display said locations, said destination location, said player symbol and movement of said player symbol;

an award associated with the destination location and provided to the player if the player symbol reaches the destination location; and at least one setback condition associated with at least one of the locations, wherein when the player symbol moves to the location having the associated setback condition, the display device is adapted to display the player symbol is relocated to one of the locations further from the destination location than said location.

2. The gaming device of claim 1, wherein the event is an occurrence of a bonus game triggering event in the game.

3. The gaming device of claim 1, which includes at least one advance condition associated with at least one of the locations, wherein when the player symbol moves to the location having the associated advance condition, the display device is adapted to display the player symbol is relocated to one of the locations closer to the destination location.

4. The gaming device of claim 1, which includes a plurality of advance conditions associated with a plurality of the locations, wherein when the player symbol moves to one of the locations having one of the associated advance conditions, the display device is adapted to display the player symbol is relocated to one of the locations closer to the destination location based on said advance condition.

5. The gaming device of claim 1, which includes a plurality of awards associated with the locations, wherein the award associated with one of the locations is provided to the player if the player does not reach the destination location.

6. A gaming device operable under the control of a processor, said gamma device comprising:

a game operable upon a wager by a player;

a plurality of locations;

at least one destination location;

a player symbol;

at least one display device operable with the processor, wherein said display device is operable after an event associated with the game to display said player symbol, the locations and the destination location;

an award associated with the destination location and provided to the player if the player symbol reaches the destination location; and a plurality of setback conditions associated with a plurality of the locations, wherein when the player symbol moves to one of the locations having an associated setback condition, the display device is adapted to display the player symbol relocated to one of the locations further from the destination location based on said setback condition associated with said location.

7. The gaming device of claim 6, wherein the event is an occurrence of a bonus game triggering event in the game.

8. The gaming device of claim 6, which includes at least one advance condition associated with at least one of the locations, wherein when the player symbol moves to the location having the associated advance condition, the display device is adapted to display the player symbol is relocated to one of the locations closer to the destination location.

9. The gaming device of claim 6, which includes a plurality of advance conditions associated with a plurality of the locations, wherein when the player symbol moves to one of the locations having one of the associated advance conditions, the display device is adapted to display the player symbol is relocated to one of the locations closer to the destination location based on said advance condition.

10. The gaming device of claim 6, which includes a plurality of awards associated with the locations, wherein the award associated with one of the locations is provided to the player if the player does not reach the destination location.

11. A gaming device operable under the control of a processor, said gaming device comprising:

a game operable upon a wager by a player;

a plurality of locations;

a plurality of destination locations;

at least one player symbol;

at least one display device operable with the processor, wherein said display device is operable after an event associated with the game to display said locations, said destination locations and said player symbol;

a different award associated with each destination location, wherein if the player symbol reaches one of the destination locations, said award associated with said destination location is provided to the player; and at least one setback condition associated with at least one of the locations, wherein when the player symbol moves to the location having the associated setback condition, the display device is adapted to display the player symbol is relocated to one of the locations further from at least one of the destination locations than said location.

12. The gaming device of claim 11, wherein the event is an occurrence of a bonus game triggering event in the game.

13. The gaming device of claim 11, which includes at least one advance condition associated with at least one of the locations, wherein when the player symbol moves to the location having the associated advance condition, the display device is adapted to display the player symbol relocated to one of the locations closer to one of the destination locations.

14. The gaming device of claim 11, which includes a plurality of advance conditions associated with a plurality of the locations, wherein when the player symbol moves to one of the locations having one of the associated advance conditions, the display device is adapted to display the player symbol is relocated to one of the locations closer to one of the destination locations based on said advance condition.

15. The gaming device of claim 11, which includes a plurality of awards associated with the locations, wherein the award associated with one of the locations is provided to the player if the player does not reach any of the destination locations.

16. A gaming device operable under the control of a processor, said gaming device comprising:

a game operable upon a wager by a player;

a plurality of locations;

at least one destination location;

a player symbol;

at least one display device operable with the processor, wherein the display device is operable after an event associated with the game to display said player symbol, the locations and the destination location;

an award associated with the destination location and provided to the player if the player symbol reaches the destination location;

at least one setback condition associated with at least one of the locations, wherein when the player symbol moves to one of the locations having an associated setback condition, the display device is adapted to display the player symbol relocated to one of the locations further from the destination location based on said setback condition associated with said location;

at least one advance condition associated with at least one of the locations, wherein when the player symbol moves to one of the locations having an associated advance condition, the display device is adapted to display the player symbol relocated to one of the locations closer to the destination location based on said advance condition; and a plurality of awards associated with the locations, wherein the award associated with one of the locations is provided to the player if the player does not reach the destination location.

17. The gaming device of claim 16, wherein the event is an occurrence of a bonus game triggering event in the game.

18. The gaming device of claim 16, which includes a plurality of setback conditions associated with a plurality of the locations.

19. The gaming device of claim 16, which includes a plurality of advance conditions associated with a plurality of the locations.

20. The gaming device of claim 16, which includes a plurality of setback conditions associated with a plurality of the locations and a plurality of advance conditions associated with a plurality of the locations.

21. A gaming device comprising:

a processor operable upon a wager made by a player;

a display device controlled by the processor; and a game operated by the processor and displayed by the display device, said game having a plurality of locations, at least one destination location, at least one symbol, at least one award associated with the destination location and provided to the player upon the symbol reaching the destination location, and at least one set back condition associated with at least one of the locations, said set back condition causing a relocation of the symbol to one of the locations further from the destination location.

22. A gaming device comprising:

a game operable upon a wager by a player;

a plurality of locations including a destination location;

at least one symbol adapted to make a plurality of moves to a plurality of the locations;

a display device operable to display said symbol and the locations;

at least one setback condition associated with at least one location; and a processor operable with the display device upon an event in the game to: (a) cause the symbol to randomly move to different locations toward the destination location; (b) when the setback condition occurs, cause the symbol to be relocated to one of the locations further from the destination location; and (c) provide a player an award based on the location of the symbol after said moves.

23. A method of operating a gaming device having a game operable upon a wager, said method comprising:

(a) displaying a plurality of locations including at least one location having a setback condition;

(b) displaying a destination location;

(c) randomly determining movement of a player symbol to one of said locations;

(d) if a setback condition is associated with said location, relocating said symbol to one of the locations further from the destination location than said location;

(e) providing an award associated with the destination location to the player if the player symbol reaches the destination location; and (f) repeating steps (c) to (d) at least once.

24. The method of claim 23, which includes relocating, the player symbol to one of the locations closer to the destination location if an advance condition is associated with the location the symbol moves to.

25. The method of claim 24, which includes a plurality of advance conditions associated with the locations.

26. The method of claim 23, which includes providing the player an award associated with one of the locations if the player does not reach the destination location.

27. The method of claim 26, which includes a plurality of awards associated with the locations.

28. The method of claim 23, which includes a plurality of setback conditions associated with a plurality of the locations.

29. The method of claim 23, which is operated through a data network.

30. The method of claim 29, wherein the data network includes the internet.

31. A method of operating a gaming device having a game operable upon a wager, said method comprising:

(a) displaying a plurality of locations including at least one location having a setback condition;

(b) displaying a plurality of destination locations;

(c) randomly determining movement of a player symbol to one of said locations;

(d) if a setback condition is associated with said location, relocating said symbol to one of the locations further from at least one of the destination locations than said location;

(e) providing an award associated with one of the destination locations to the player if the player symbol reaches said destination location; and (f) repeating steps (c) to (d) at least once.

32. The method of claim 31, which includes relocating the player symbol to one of the locations closer to the destination location if an advance condition is associated with the location the symbol moves to.

33. The method of claim 32, which includes a plurality of advance conditions associated with the locations.

34. The method of claim 31, which includes providing the player an award associated with one of the locations if the player does not reach the destination location.

35. The method of claim 34, which includes a plurality of awards associated with the locations.

36. The method of claim 31, which includes a plurality of setback conditions associated with a plurality of the locations.

37. The method of claim 31, which is operated through a data network.

38. The method of claim 37, wherein the data network includes the internet.

39. A method of operating a gaming device having a game operable upon a wager, said method comprising:

(a) displaying a plurality of locations including at least one location having a setback condition;

(b) displaying a destination location;

(c) determining movement of a player symbol to one of said locations;

(d) if a setback condition is associated with said location, relocating said symbol to one of the locations further from the destination location than said location;

(e) providing an award associated with the destination location to the player if the player symbol reaches the destination location; and (f) repeating steps (c) to (d) at least once.

40. The method of claim 39, which includes relocating the player symbol to one of the locations closer to the destination location if an advance condition is associated with the location the symbol moves to.

41. The method of claim 39, which is operated through a data network.

42. The method of claim 41, wherein the data network includes the internet.

43. A method of operating a gaming device having a game operable upon a wager, said method comprising:

(a) displaying a plurality of locations including at least one location having a setback condition;

(b) displaying a plurality of destination locations;

(c) determining movement of a player symbol to one of said locations;

(d) if a setback condition is associated with said location, relocating said symbol to one of the locations further from at least one of the destination locations than said location;

(e) providing an award associated with one of the destination locations to the player if the player symbol reaches said destination location; and (f) repeating steps (c) to (d) at least once.

44. The method of claim 43, which includes relocating the player symbol to one of the locations closer to the destination location if an advance condition is associated with the location the symbol moves to.

45. The method of claim 43, which is operated through a data network.

46. The method of claim 45, wherein the data network includes the internet.

* * * * *